United States Patent [19]

Walker

[11] 3,956,855

[45] May 18, 1976

[54] DOOR FRAME STRUCTURE WITH SAFETY LOCK BRACKET

[75] Inventor: Patrick J. Walker, Chicago, Ill.

[73] Assignee: United States Gypsum Company, Chicago, Ill.

[22] Filed: June 26, 1974

[21] Appl. No.: 483,347

[52] U.S. Cl. ..... 49/504; 52/213; 52/656; 403/231

[51] Int. Cl.[2] ..... E06B 1/04

[58] Field of Search ..... 52/211–215, 52/656, 758 H, 710, 714, 741; 248/300, 301; 403/231, 295; 49/408, 504

[56] References Cited

UNITED STATES PATENTS

| | | | |
|---|---|---|---|
| 1,180,314 | 4/1916 | Olberg | 52/215 X |
| 2,700,441 | 1/1955 | Cudini | 52/214 |
| 2,856,040 | 10/1958 | Dansereau | 49/408 |
| 3,021,576 | 2/1962 | Conroy | 52/758 H X |
| 3,276,802 | 10/1966 | O'Brien | 52/758 H |
| 3,509,666 | 5/1970 | Trout | 49/504 |
| 3,730,466 | 5/1973 | Swanquist | 52/714 |

*Primary Examiner*—Alfred C. Perham
*Attorney, Agent, or Firm*—Samuel Kurlandsky; Stanton T. Hadley; Donnie Rudd

[57] ABSTRACT

A safety lock bracket is provided for affixing the end of a door frame header having internal roller tracks to the end of a door jamb over which it is mounted.

3 Claims, 6 Drawing Figures

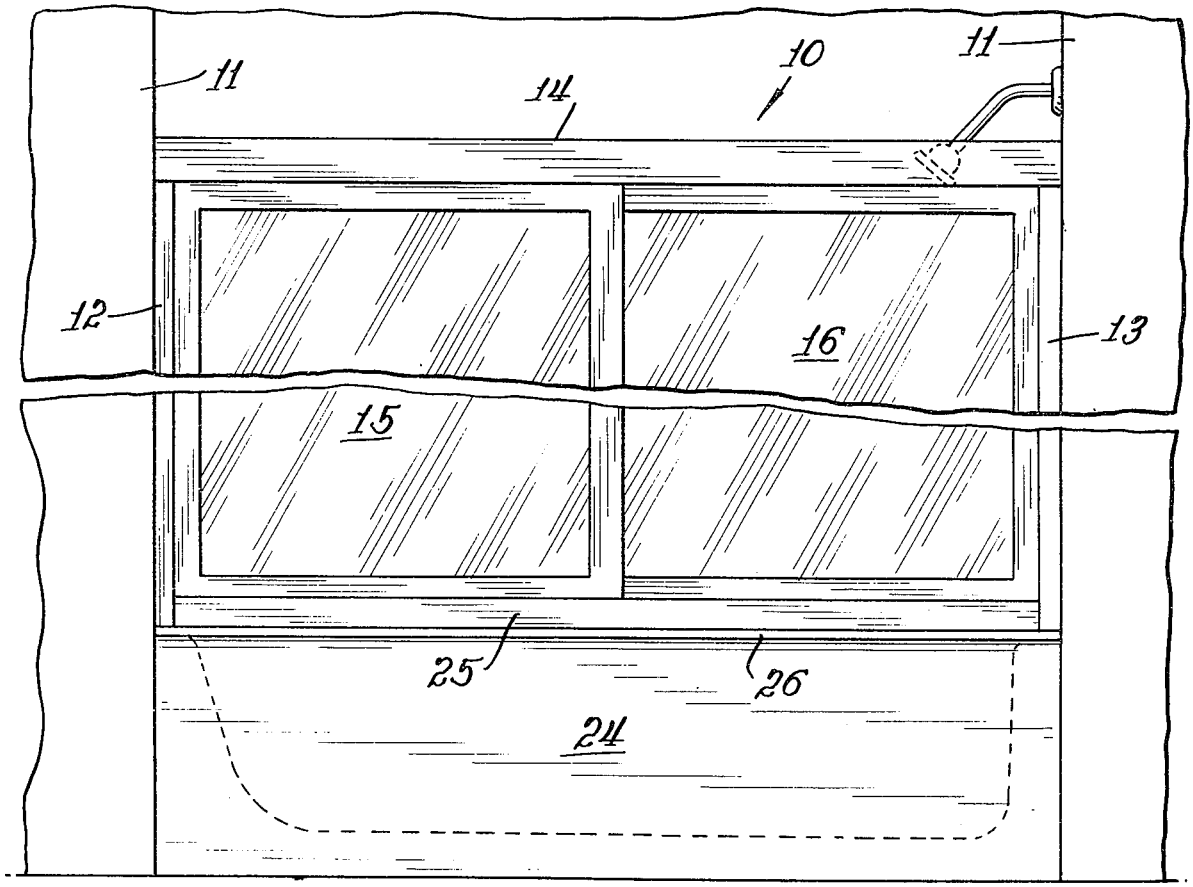
Fig. 1.
Fig. 2.
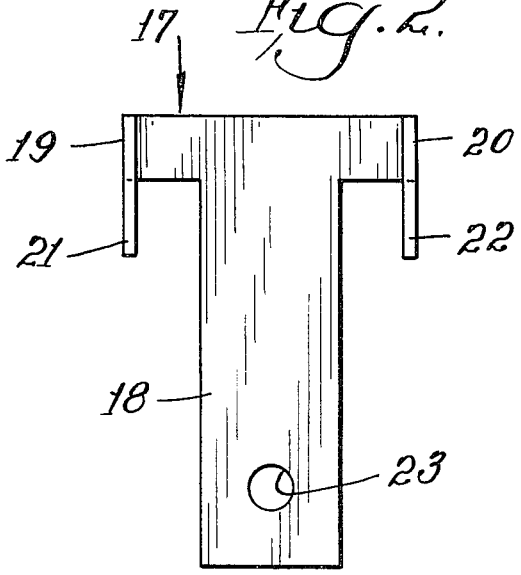
Fig. 3.
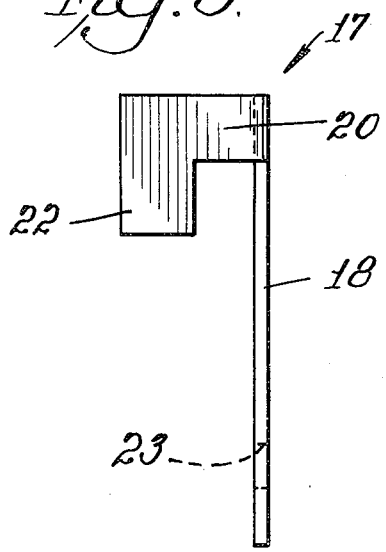

DOOR FRAME STRUCTURE WITH SAFETY LOCK BRACKET

BACKGROUND OF THE INVENTION

1. Field of Invention

The present invention relates to door frames, and is more particularly concerned with a bracket for affixing the ends of a door frame header to the ends of the supporting jambs.

2. Prior Art

Metal door frames for sliding doors and particularly shower doors mounted on a bathtub generally comprise a pair of space-apart vertical door jambs and a header horizontally positioned and having its ends mounted over the ends of the door jambs. The door jambs are conventionally adhesively affixed to the wall and the header either left unaffixed to the jambs and merely resting thereon, or alternatively adhesively affixed or affixed by screws in some manner. The door jambs are generally channel form and fabricated by stamping or extrusion, and the headers are generally extruded to the desired shape including parallel spaced-apart tracks for rollers affixed to the doors and arranged to permit the doors to slide back and forth.

It has been conventional in the construction of by-pass doors to mount the door jambs into the wall and to cut the header to length to fit between the walls and to rest on top of the ends of the jambs. Since there generally is no connection between the jambs and the headers, the header can be accidentally dislodged by someone standing up or straightening up underneath the header. More recently structures have been disclosed wherein a portion of the wall jambs are notched away to leave a T-shape in the cross web of the wall jamb which it is possible to interlock with the header cross-section. In installing such an assembly, one jamb is at first installed, the header is then cut to size and engaged with the jamb, and subsequently the other jamb is engaged with the header and the assembly swung into place. To do this one must handle two pieces of metal connected together at right angles and to set them in place before proceeding to fasten the second jamb. This is somewhat of a cumbersome operation and requires that once installed and caulked in, if the header is to be removed, the caulking must be destroyed, thereby removing the water seal from behind the jamb.

SUMMARY OF THE INVENTION

It is therefore an object of the present invention to provide an improved corner lock means for locking the ends of a header to the door jambs which support it.

It is a further object of the present invention to provide a locking means of the type described which provides positive locking over extended periods of time.

It is another object of the invention to provide a lock means which may be inexpensively fabricated from readily available materials.

It is still another object of the invention to provide a locking means which enables the door frame assembly to be easily mounted and locked in place, and then to be disassembled when desired without the need to destroy the water seal.

Other objects and advantages of the invention will be acquired from the following description when taken in conjunction with the accompanying drawing.

BRIEF DESCRIPTION OF THE DRAWING

FIG. 1 is a front elevation view showing a door and door frame mounted in a wall.

FIG. 2 is a plan view of a lock bracket according to the invention.

FIG. 3 is a side view of the bracket of FIG. 2.

DESCRIPTION OF THE PREFERRED EMBODIMENT

Figure 5:
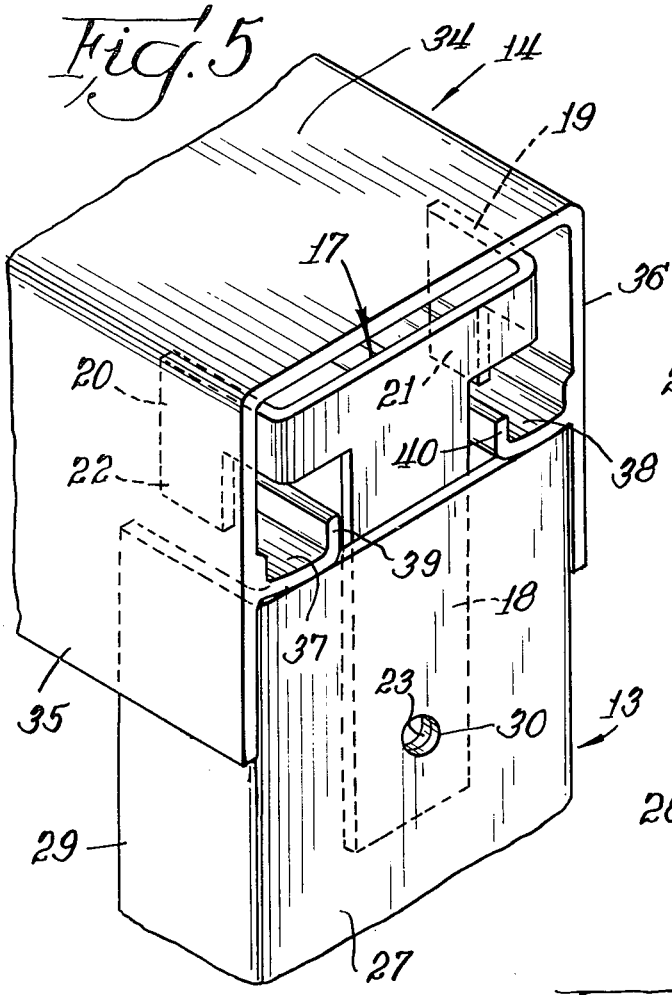
FIG. 5 is a fragmentary perspective view showing a header end mounted on the end of a door jamb with the lock bracket of the invention mounted in place.

Referring to FIG. 1, a header and door jamb assembly 10 is shown mounted in a wall 11. The assembly includes a pair of door jambs 12 and 13 adhesively affixed to the wall 11, mounted in a tub track 25 supported by a vinyl gasket 26 on a bath tub 24, and supporting a header 14 thereon. Doors 15 and 16 are mounted by means of rollers riding in tracks provided in the header.

Referring to FIGS. 2 and 3, a safety lock bracket 17 is shown formed of a T-shaped blank and comprising an elongate body member 18 and arms 19 and 20 extending for a short distance coplanar with the body member, bending at an elbow, and the remainder disposed substantially perpendicularly to the body member 18, both arms extending in the same direction with respect thereto. At the ends of the arms 19 and 20 are depending track-engaging members 21 and 22, respectively, the track-engaging members 21 and 22 preferably being substantially co-planar with respect to their respective arms. An aperture 23 is provided for receiving a fastening means such as a screw or nail.

Figure 4:
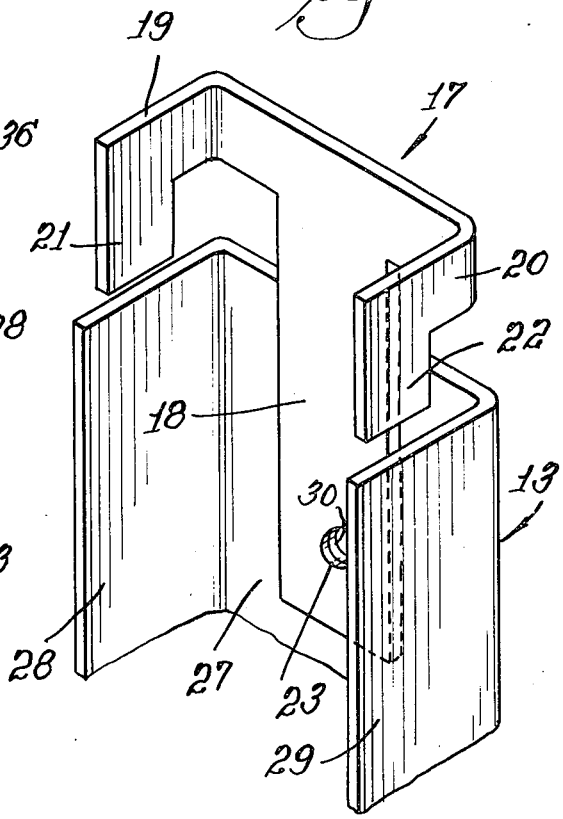
FIG. 4 is a fragmentary perspective view showing how the bracket is mounted with respect to a wall jamb.

Referring to FIG. 4, a door jamb 13 is shown comprising a primary web 27 and flanges 28 and 29. An aperture 30 is provided in the primary web. The lock bracket 17 is shown positioned with its aperture 23 juxtaposed with the aperture 30 of the door jamb, the position in which the lock bracket is ultimately placed.

Referring to FIG. 5, a header 33 is shown having one end mounted on the end of the door jamb 13. The header 33 is formed of extruded metal such as aluminum and comprises a primary web 34, and side flanges 35 and 36. Tracks 37 and 38 are connected to the side flanges 35 and 36, respectively, and have guide flanges 39 and 40 for supporting and guiding door rollers (not shown).

Figure 6:
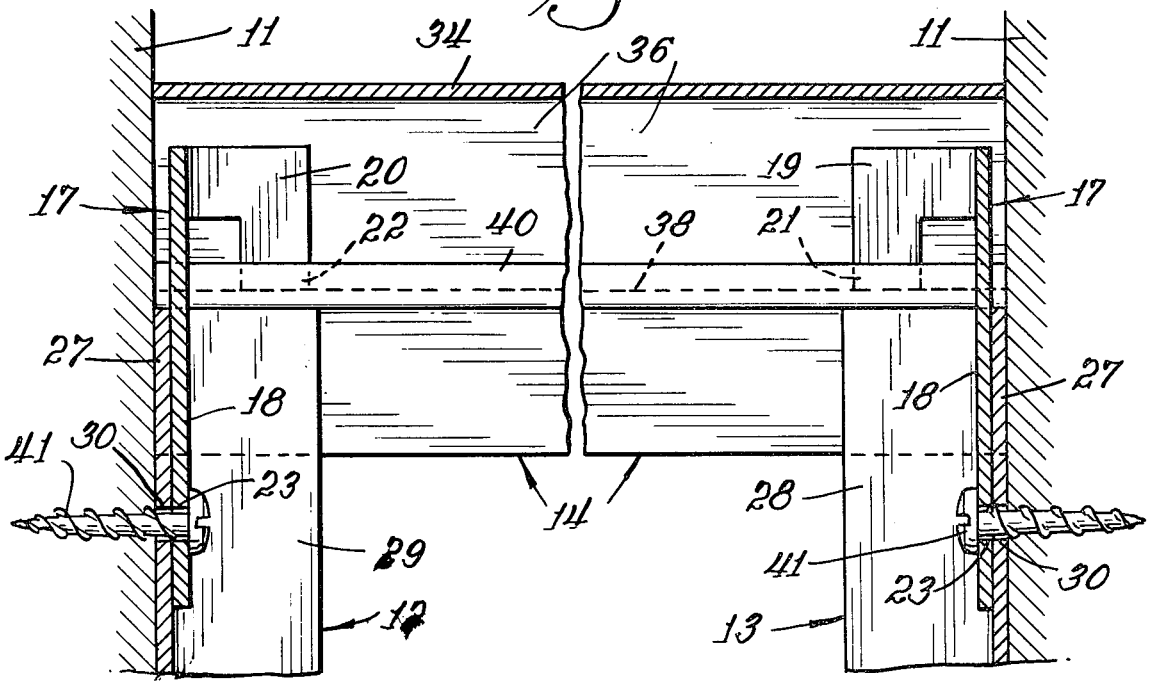
FIG. 6 is a fragmentary cross-sectional view showing the ends of a header and door jambs in locked relationship and mounted to a wall.

In assembling the door frame, the door jambs 12 and 13 are provided with a pressure sensitive adhesive on the outer surface of the primary webs having a strippable backing. In assembly, the backing is removed and the jambs are pressed against the wall edges where they become adhesively affixed. The header is then placed with its ends engaging the jambs, as shown in FIGS. 5 and 6. The bracket 17 is then inserted into the space between the roller track guide flanges 39 and 40 with the bracket oriented at an angle of 90° with respect to its ultimate position in the frame assembly. The bracket is raised sufficiently so that the track-engaging members 21 and 22 clear the upper edges of the guide flanges 39 and 40. The bracket is then rotated 90° and lowered until the ends of the engaging members 21 and 22 engage the tracks 37 and 38. The bracket is then slid along the track until the body member 18 engages the primary web 27 of the jamb 13, with the aperture 23 of the bracket in register with the aperture 30 of the jamb 13, as shown in FIG. 5. A screw 41 is then inserted through the apertures 23 and 30 and driven into the wall 11, attaining the structure shown in FIG. 6. In this position the bracket provides positive restraint of the header against upward movement.

The safety lock bracket of the invention has a number advantages over prior art structures. First, it provides a very positive and secure restrain against upward movement of the header. Second, it facilitates assembly of the door frame structure. Third, it is relatively easy and inexpensive to fabricate.

It is to be understood that the invention is not to be limited to the exact details of operation or structure shown and described in the specification and drawing, since obvious modifications and equivalents will be readily apparent to one skilled in the art.

I claim:

1. A door frame structure comprising in combination:

1. a pair of spaced-apart channel-form jambs each comprising a major web having a fastener means-receiving aperture therein and adapted to engage a wall, and having a pair of flanges,
2. a channel-form header comprising a major web, depending flanges, and a pair of spaced-apart tracks connected to said depending flanges having its end mounted over the ends of said jambs with the ends of the jambs engaging said spaced-apart tracks,
3. a safety lock bracket mounted at each end of said header comprising a T-form body member having a pair of arms at the upper portion thereof having portions coplanar with said body member, each portion terminating in an elbow connecting to portions extending in the same direction and substantially perpendicular to said body member, the ends of said perpendicular portions terminating in depending track-engaging members engaging and vertically restraining said spaced-apart tracks, and
4. fastening means extending through apertures in said jambs and said brackets and adapted to be driven into said walls.

2. The combination according to claim 1, wherein said tracks are provided with upwardly extending guide flanges and the arms of said brackets are arranged to clear said guide flanges.

3. A method for erecting a door frame to a pair of spaced-apart vertical walls, which comprises:

1. affixing channel-form jambs to each vertical wall edge,
2. mounting a header over the ends of both jambs, the upper ends of said jambs engaging a pair of spaced-apart tracks affixed to the walls of the header,
3. placing a safety lock bracket transposed 90° to its final position through the space between said spaced-apart tracks at each end of said header, said bracket comprising a T-form body member having a pair of arms at the upper portion thereof having portions coplanar with said body member, each portion terminating in an elbow connecting to portions extending in the same direction with respect to each other and substantially perpendicular to said body member, the ends of said perpendicular portions terminating in depending track-engaging members,
4. rotating said brackets 90° and permitting said track-engaging members to be engaged in said tracks, sliding said brackets to the ends of said header in engagement with said jambs, and inserting a fastening means through apertures provided in said jambs and said brackets and imbedding said fastening means in said walls.

* * * * *